US006234702B1

(12) United States Patent
Jeunehomme et al.

(10) Patent No.: US 6,234,702 B1
(45) Date of Patent: May 22, 2001

(54) SWIVEL COUPLING

(75) Inventors: Sylvie Jeunehomme, Salles sur Mer; Jean-Claude Gaiguant, Chatelaillon Plage, both of (FR)

(73) Assignee: GEC Alsthom Transport SA, Paris (FR)

( * ) Notice: Subject to any disclaimer, the term of this patent is extended or adjusted under 35 U.S.C. 154(b) by 0 days.

(21) Appl. No.: 09/164,572

(22) Filed: Oct. 1, 1998

(30) Foreign Application Priority Data

Oct. 2, 1997 (FR) ..... 97 12265

(51) Int. Cl.[7] ..... B61G 1/00

(52) U.S. Cl. ..... 403/78; 403/120; 403/228; 105/3; 213/75 R

(58) Field of Search ..... 105/3, 4.3; 213/75 R; 403/78, 76, 164, 165, 122, 120, 228, 225

(56) References Cited

U.S. PATENT DOCUMENTS 2,886,299 * 5/1959 Heimaster et al. ..... 403/76
4,942,824 * 7/1990 Cros ..... 105/4.3
5,033,722 * 7/1991 Lammers ..... 403/228 X
5,271,678 * 12/1993 Bourgeot ..... 105/3 X
5,456,185 * 10/1995 Rother et al. ..... 105/3
5,507,400 * 4/1996 Long et al. ..... 213/75 R
5,520,295 * 5/1996 Wiebe ..... 213/75 R
5,560,503 * 10/1996 Daugherty, Jr. ..... 213/75 R
5,586,506 * 12/1996 Heubusch et al. ..... 105/3
5,615,786 * 4/1997 Hoyon et al. ..... 105/3
5,809,898 * 9/1998 Kaufhold et al. ..... 105/3 X

FOREIGN PATENT DOCUMENTS 1 040 063 10/1958 (DE) .
0 667 271 A1 8/1995 (EP) .
2 348 092 11/1997 (FR) .

* cited by examiner

*Primary Examiner*—Lynne H. Browne
*Assistant Examiner*—David E. Bochna
(74) *Attorney, Agent, or Firm*—Sughrue, Mion, Zinn, Macpeak & Seas, PLLC

(57) ABSTRACT

A swivel coupling for coupling together two vehicles, in particular two rail vehicles. The swivel coupling rests on a shared bogie between the two vehicles and has a rotation function and a shock-absorbing function. Each of these functions is performed by distinct elements of the swivel coupling structure.

3 Claims, 3 Drawing Sheets

SWIVEL COUPLING

The present invention relates generally to link devices or linking together vehicles, in particular rail vehicles, to make up an articulated train set, and more particularly to a swivel coupling for coupling together two vehicles, in particular two rail vehicles.

BACKGROUND OF THE INVENTION

The Applicant's Document EP-A-0 667 271 describes a swivel coupling for coupling together two rail vehicles. That swivel coupling rests on a shared bogie between said two rail vehicles, and it comprises:

a toroidal part connected to one of the vehicles;

a support part connected to the other vehicle;

a cylindrical pivot fixed to a soleplate, and engaged in a cylindrical bore; and a toroidal swivel element fixed to said soleplate and enabling said soleplate to swivel relative to said toroidal part.

A toroidal swivel element enables a soleplate to swivel relative to the toroidal part.

That toroidal swivel element is a structure made up of multiple successive layers of metal and of rubber that can be of stiffnesses that are different and that vary progressively.

A major drawback with the swivel coupling for coupling together two rail vehicles as described in the prior art document is that the angular displacements which it permits are small.

In the particular case of body-tilting vehicles, the swivel coupling for coupling together two rail vehicles as described in the prior art document cannot accommodate displacement about the longitudinal axis without producing an opposing force.

The fundamental drawback of such an opposing force is that it twists the body.

The swivel coupling for coupling together two vehicles as described in the prior art document suffers from the drawback of being stiff and therefore of twisting the bodies of body-tilting vehicles as they go round curved portions of track.

OBJECTS AND SUMMARY OF THE INVENTION

An object of the invention is to provide a swivel coupling for coupling together two vehicles, in particular two rail vehicles, that accommodates displacement about the longitudinal axis without producing any opposing force so as to avoid any twisting of the bodies.

According to the invention, in the swivel coupling for coupling together two vehicles, in particular two rail vehicles, which swivel coupling rests on a shared bogie between said two vehicles and has both a rotation function and a shock-absorbing function, each function, namely the rotation function and the shock-absorbing function, is performed by distinct elements.

The swivel coupling of the invention also satisfies at least one of the following characteristics:

the swivel coupling comprises:

a toroidal central part having a frustoconical bearing surface;

a ball having a hollow conical central portion that fits over the frustoconical bearing surface of the toroidal central part;

resilient elements;

a disk; and a holding screw including a vertical pivot;

the top portion of the toroidal part is provided with the frustoconical bearing surface, and its bottom portion is connected to the underframe of the body of one of the vehicles;

the ball associates a first element that is spherical in overall shape with a second element that is external and that is disposed to rotate freely on the first element;

there are two resilient elements, and they are semi-circular in overall shape and are disposed symmetrically on either side of the ball and of the longitudinal axis of the vehicle so as to bear against the outside surface of the second element of the ball;

the disk is disposed between the underframe of the body of one of the vehicles and a support part for supporting the swivel coupling;

the disk holds the second element of the ball on the first element of the ball;

the support part is connected to the underframe of the body of one of the vehicles;

the support part supports the toroidal central part via the bottom portion thereof;

the vertical pivot of the holding screw is engaged in the center of the toroidal central part, and it is fixed thereto by means of thread; and the bottom portion of the toroidal central part is recessed to receive the body/bogie drive.

An advantage of the swivel coupling of the invention for coupling together two rail vehicles is that it is particularly flat because of its compactness.

Another advantage of the swivel coupling of the invention for coupling together two rail vehicles is that it can be integrated both into tilting articulated rolling stock and into non-tilting articulated rolling stock. Another advantage of the swivel coupling of the invention for coupling together two rail vehicles is that it enables the floor level of the connection corridor to be lowered by about 200 mm.

BRIEF DESCRIPTION OF THE DRAWINGS

Other objects, characteristics, and advantages of the invention appear on reading the following description of a preferred embodiment of the swivel coupling for coupling together two rail vehicles, given with reference to the accompanying drawings, in which.

MORE DETAILED DESCRIPTION

According to an essential characteristic, with the swivel coupling for coupling together two vehicles A and B, in particular two rail vehicles, resting on a shared bogie (not shown) between the two vehicles and having both a rotation function and a shock-absorbing function, said swivel coupling is such that each function, namely the rotation function and the shock-absorbing function, is performed by distinct elements.

Figure 1:
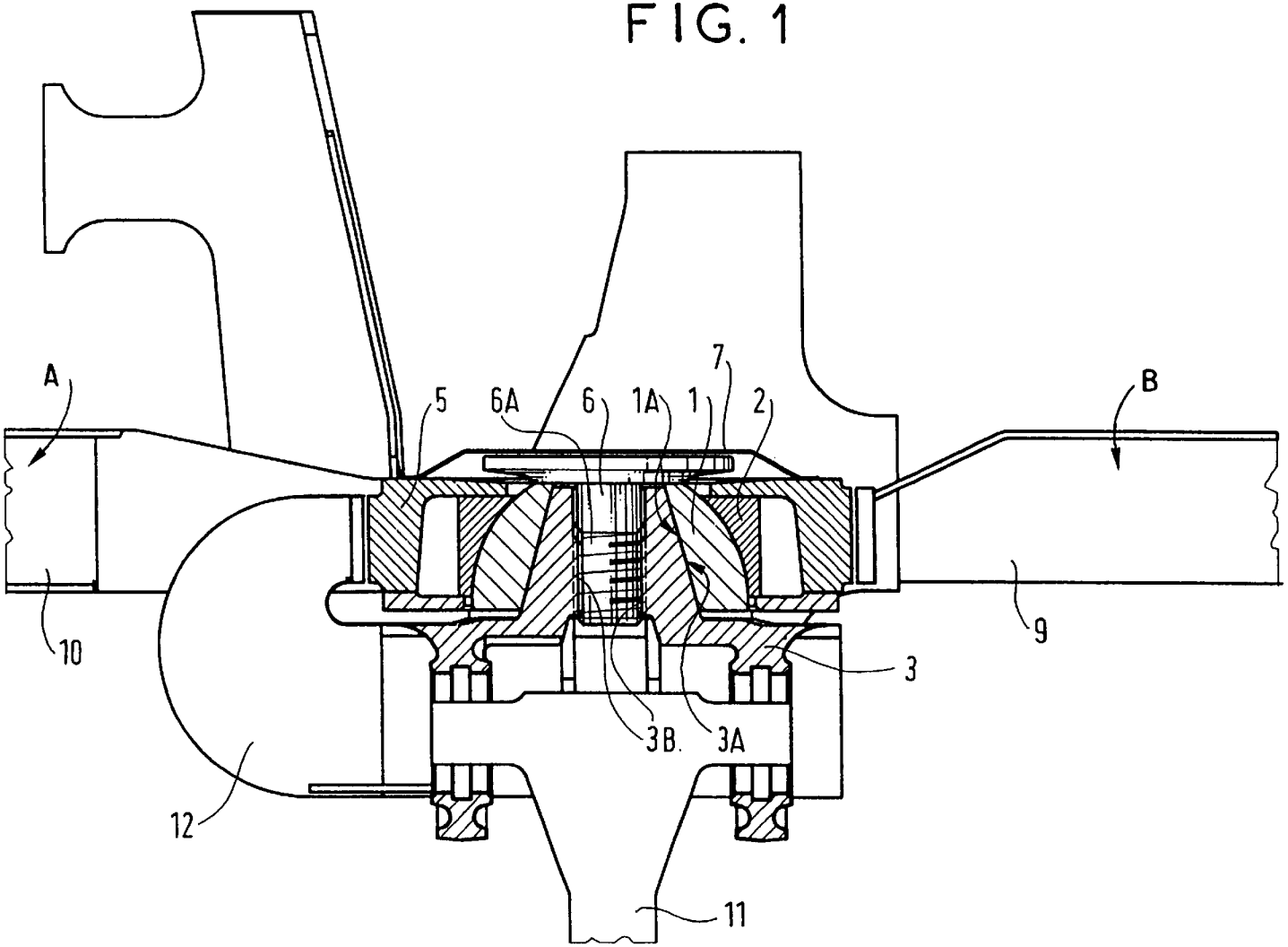
FIG. 1 is a section view on a longitudinal plane of symmetry, showing a swivel coupling of the invention.
Figure 2:
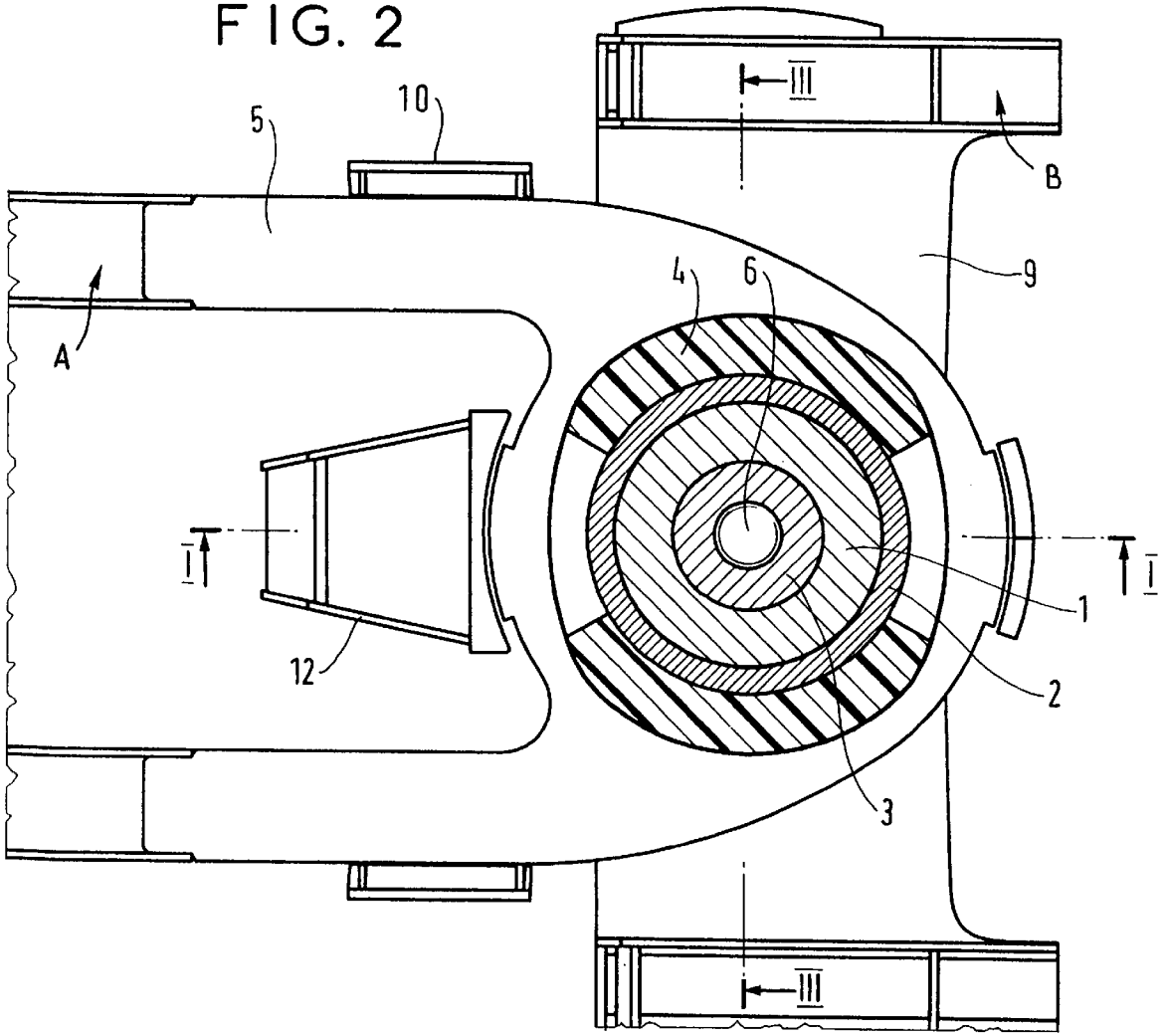
FIG. 2 is a section view from above on a horizontal plane, showing the swivel coupling of the invention
Figure 3:
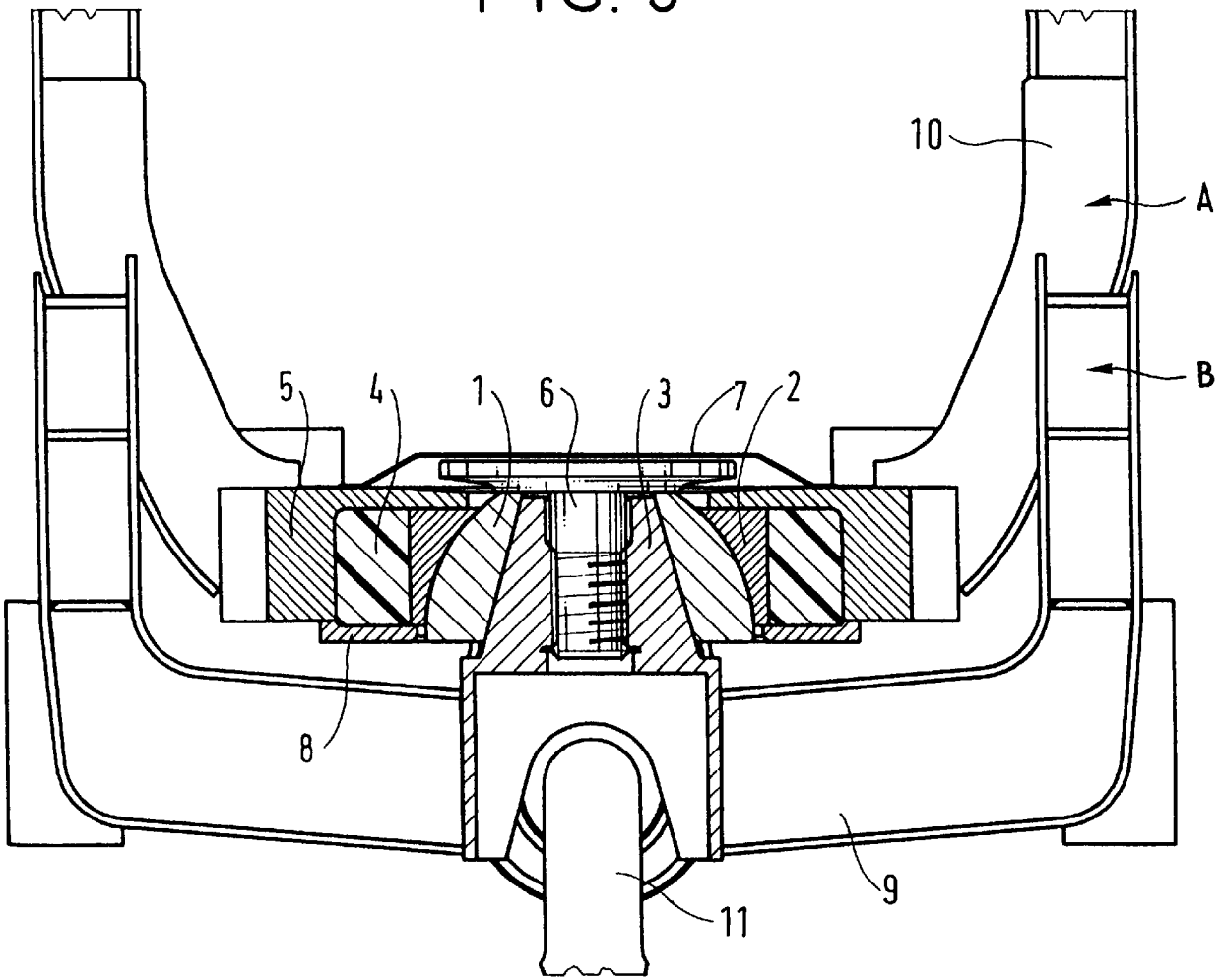
FIG. 3 is a front view in cross-section, showing the swivel coupling of the invention.

As shown in FIGS. 1 to 3, the swivel coupling comprises a toroidal central part 3 having a frustoconical bearing surface 3A, a ball 1, 2 having a hollow conical central portion 1A that fits over the frustoconical bearing surface 3A of the toroidal central part 3, resilient elements 4, a disk 5, and a holding screw 6 including a vertical pivot 6A.

The top portion of the toroidal central part 3 is provided with the frustoconical bearing surface 3A, and its bottom portion is connected to the underframe 9 of the body of one of the vehicles B.

The ball 1, 2 associates a first element 1 that is spherical in overall shape with a second element 2 that is external and that is disposed to rotate freely on the first element 1.

There are preferably two resilient elements 4, and they are semi-circular in overall shape and are disposed symmetrically on either side of the ball 1, 2 and of the longitudinal axis of the vehicle so as to bear against the outside surface of the second element 2 of the ball 1, 2.

The disk 5 is disposed between the underframe 9 of the body of one of the vehicles B and a support part 12 for supporting the swivel coupling.

The disk 5 holds the second element 2 of the ball 1, 2 on the first element 1 of the ball 1, 2.

The support part 12 is connected to the underframe 9 of the body of one of the vehicles B and is, for example, made up of a plurality of welded-together elements.

The support part 12 supports the toroidal central part via the bottom portion thereof.

The vertical pivot 6A of the holding screw 6 is engaged in the center of the toroidal central part 3, and it is fixed thereto by means of thread 3B.

The bottom portion of the toroidal central part 3 is recessed to receive the body/bogie drive 11.

The holding screw 6 prevents any dislocation of the assembly, e.g. on going over a major defect in the track.

A top protective cover 7 and a bottom collar 8 protect the swivel coupling from any damage that might be caused by objects, e.g. ballast, being thrown up.

The disk 5 is connected to the underframe 10 of the body of the other vehicle A.

The disk 5 is dimensionally stable, and each of its ends forms a buffer.

The disk 5 is calibrated as a function of the type of rolling stock on which it is mounted. By way of example, the strength of this part lies in the range 20 kN to 3,000 kN.

The disk 5 may be made of steel, of a titanium alloy, of an aluminum alloy, or of composite materials.

The resilient elements 4 disposed symmetrically on either side of the ball 1, 2 and of the longitudinal axis of the vehicle absorb energy while imparting high longitudinal flexibility.

The resilient elements 4 offer high transverse stiffness.

The energy absorption takes place in the longitudinal direction of the vehicle, and more particularly during traction and braking, and during docking, and it avoids any risk of the ball 1, 2 being bruised.

What is claimed is:

1. A swivel coupling for coupling together two vehicles, the swivel coupling resting on a shared bogie between said two vehicles and having both a rotation function and a shock-absorbing function, wherein the rotation function is performed by a ball and the shock-absorbing function is performed by resilient elements, comprising:

a toroidal central part acting as a bearing surface, wherein the toroidal central part has a frustoconical bearing surface; and the ball has a hollow conical central portion that fits over the frustoconical bearing surface of the toroidal central part, further comprising:

a disk; and a holding screw including a vertical pivot.

2. A swivel coupling for coupling together two vehicles, the swivel coupling resting on a shared bogie between said two vehicles and having both a rotation function and a shock-absorbing function, wherein the rotation function is performed by a ball and the shock-absorbing function is performed by resilient elements, comprising:

a toroidal central part acting as a bearing surface, wherein the ball associates a first element that is spherical in overall shape with a second element that is external and that is disposed to rotate freely on the first element.

3. A swivel coupling for coupling together two vehicles, the swivel coupling resting on a shared bogie between said two vehicles and having both a rotation function and a shock-absorbing function, wherein the rotation function is performed by a ball and the shock-absorbing function is performed by resilient elements, comprising:

a toroidal central part acting as a bearing surface, in which said resilient elements are semi-circular in overall shape and disposed symmetrically on either side of the ball and of the longitudinal axis of said two vehicles so as to bear against the outside surface of a second element of the ball.

* * * * *